US006698113B1

(12) United States Patent
Jones et al.

(10) Patent No.: US 6,698,113 B1
(45) Date of Patent: Mar. 2, 2004

(54) DECELERATING FLUID ACTUATOR FOR SNOWPLOWS AND OTHER HEAVY MACHINERY

(76) Inventors: Jayson D. Jones, 5337 Reiner Rd., Madison, WI (US) 53704; Martin Gagnon, 560 Rue Principale, Apt. 3, St. Ambroise de Kildaire Quebec (CA), J0K 1C0

( * ) Notice: Subject to any disclaimer, the term of this patent is extended or adjusted under 35 U.S.C. 154(b) by 0 days.

(21) Appl. No.: 10/337,539

(22) Filed: Jan. 7, 2003

Related U.S. Application Data

(60) Provisional application No. 60/346,533, filed on Jan. 8, 2002.

(51) Int. Cl.[7] ..... E01H 5/00

(52) U.S. Cl. ..... 37/234

(58) Field of Search ..... 60/413, 414, 553, 60/534, 476, 477; 91/408, 409, 399; 414/694, 695.5; 92/82, 164, 171.1, 80, 163; 37/234, 232, 233, 235, 236

(56) References Cited

U.S. PATENT DOCUMENTS 4,207,951 A * 6/1980 Wilcox et al. ..... 172/225
5,018,934 A * 5/1991 Steinkamp et al. ..... 414/695.5
5,177,887 A * 1/1993 McGugan et al. ..... 37/236
5,265,356 A * 11/1993 Winter ..... 37/234
5,279,014 A * 1/1994 Wise et al. ..... 15/82
5,461,965 A * 10/1995 Schwaegerle ..... 91/408

* cited by examiner

*Primary Examiner*—Robert E. Pezzuto
(74) *Attorney, Agent, or Firm*—Craig A. Fieschko, Esq.; DeWitt Ross & Stevens S.C.

(57) ABSTRACT

A plow including a plowing vehicle and a moldboard has a decelerating fluid actuator which allows adjustable positioning of the moldboard with respect to the plowing vehicle. The cylinder has first and second ports which are successively blocked as the piston is retracted within the cylinder, with the second port being blocked after the first port during retraction. An enclosure is provided outside the cylinder, with the enclosure interior defining a passage between the ports and connecting the ports to a fluid supply. The flow area of the passage between the ports is adjustable to create a restriction. As a result, when the piston begins retraction, the retraction speed is dictated by flow through both ports, and when the piston retracts to a sufficient degree that the first port is blocked, retraction speed is dictated by the flow through the second port and the passage. The size of the passage may be varied by insertion and removal of differently-sized restrictors therein, or by the degree of insertion or removal of a restrictor within the passage. The foregoing arrangement allows the fluid actuator to move the moldboard at a first speed with respect to the plowing vehicle over a portion of its range of motion, and at a lower second speed over the remainder of its motion. Thus, the retraction speed of a moldboard may be reduced as it approaches the plowing vehicle, decreasing the possibility of collision and damage.

16 Claims, 4 Drawing Sheets

PRIOR ART

DECELERATING FLUID ACTUATOR FOR SNOWPLOWS AND OTHER HEAVY MACHINERY

CROSS-REFERENCE TO RELATED APPLICATIONS

This application claims priority under 35 USC §119(e) to U.S. Provisional Patent Application No. 60/346,533 filed Jan. 8, 2002, the entirety of which is incorporated by reference herein.

FIELD OF THE INVENTION

This disclosure concerns an invention relating generally to actuators for heavy machinery, and more specifically to fluid actuators (i.e., hydraulic and/or pneumatic actuators) used in snowplows to reposition plow moldboards with respect to the plowing vehicle.

BACKGROUND OF THE INVENTION

In machinery wherein heavy components are repositioned with respect to the remainders of the machines—for example, in plows where plow moldboards are repositioned with respect to the plowing vehicle—it is often useful to have some form of means for decelerating the heavy component as it approaches the remainder of the machine to reduce the chance of collision between components. As an example, consider FIG. 1, which illustrates an exemplary snowplowing vehicle at 100. The snowplowing vehicle 100 has a front moldboard 102, and a side moldboard 104 (commonly referred to as a wing plow because it is unfoldable from the plowing vehicle 100 like a wing). The wing plow 104 is hingedly affixed to the plowing vehicle 100 at an inner end 106, and a fluid actuator 108 (generally a hydraulic actuator) extends between the plowing vehicle 100 and the midsection of the wing plow 104 to move the wing plow 104 between the folded and unfolded positions. When standard hydraulic actuators are used at 108, problems sometimes arise when the actuator 108 is retracted. The wing plow 104 is pulled towards the plowing vehicle 100, and depending on the fastening arrangement between the wing plow 104 and the plowing vehicle 100, its retraction speed may increase as the wing plow 104 approaches the plowing vehicle 100. This may lead to collision between the wing plow 104 and the plowing vehicle 100, particularly when the wing plow 104 is more flexible and/or when the retraction speed is high. Even where the wing plow 104 is withdrawn at constant or diminishing speed, the inertia of the heavy wing plow 104 generally causes it to overshoot its standard at-rest folded position during retraction, and thereby causes it to collide with a plowing vehicle 100.

Because of the size and weight of the wing plow 104, it is capable of inflicting thousands of dollars of damage on the plowing vehicle 100 if the impact is significant. Such damage often occurs owing to the speed of plowing operations. Cities and counties necessarily try to limit their fleets of plowing vehicles 100 to no more than the minimum number of plows necessary because each plowing vehicle 100 involves a significant capital investment which is only used during a small portion of the year. However, during periods of heavy snow, public safety demands that the roads be cleared as soon as possible. Thus, the operator of each plowing vehicle 100 is concerned with clearing as much snow as possible, as soon as possible. The plowing vehicles 100 are therefore operated at slow driving speeds, generally 20–30 mph in residential areas, though faster speeds may be used on highways and on highly-traveled thoroughfares where fast clearance is needed for safety. During operation, the plow moldboards must often be rapidly repositioned for effective road clearance and/or to avoid obstacles, and the need for rapid repositioning may increase where there are driving conditions of low visibility. As an example, the wing plow 104 may need to be rapidly folded adjacent the plowing vehicle 100 when the operator of the vehicle 100 suddenly sees a mailbox or other object within the path of the wing plow 104. The wing plow 104 may then be retracted at such a speed that it strikes the cab of the vehicle 100, which may cause significant damage. The problem cannot be avoided by driving more slowly owing to the aforementioned need for rapid plowing; additionally, the operator cannot simply allow the wing plow 104 to strike objects in its path, since this will rapidly destroy the wing plow 104 (as well as the vehicle hydraulics owing to the shock to actuator 108).

A number of modifications have been made to plow actuators (such as actuator 108) to attempt to allow more rapid actuation without impact on the plowing vehicle 100. A first approach is illustrated in FIG. 2, wherein a cross-sectional view of a modified wing plow fluid actuator 200 is shown. The fluid actuator 200 includes an actuator arm 202 which is driven by a piston 204 moving within a cylinder casing 206. One of the piston 204 and the cylinder casing 206 is affixed to the plowing vehicle 100 or associated structure, while the other is affixed to the plow moldboard or associated structure, so that extension and retraction of the piston 204 within the cylinder casing 206 actuates the plow moldboard with respect to the plowing vehicle 100. Within the cylinder casing 206, the piston 204 is driven by fluid pumped into (or from) a face port 208 situated in front of the face of the piston 204, and a tail port 210 situated on the opposite side of the piston 204. Hydraulic lines 212 are shown connected to each of the face port 208 and tail port 210. A restrictor 214 containing an orifice with reduced flow area is situated between the face port 208 and its hydraulic line 212. Thus, when the actuator arm 202 is retracted within the cylinder casing 206 by pumping hydraulic fluid into the tail port 210 and/or out of the face port 208, the restrictor 214 causes the piston 204 to travel more slowly owing to the decreased flow area it presents for withdrawal of hydraulic fluid. While this works well in helping to deter harsh impact of the wing plow 104 on the plowing vehicle 100, it is disadvantageous in that folding and unfolding of the wing plow 104 is slowed throughout the entire range of motion of the actuator arm 202. Therefore, this modification is disadvantageous where the wing plow 104 needs to be rapidly deployed or withdrawn.

Owing to this problem, the fluid actuator 300 shown in FIGS. 3–4 was developed. Such a fluid actuator 300 is commonly referred to in the industry as a "cushion cylinder" or "decel" (deceleration) cylinder because retraction is initially fast, but it slows in the latter part of retraction to avoid the shock of moldboard impact. Fluid actuator 300 is similar to the fluid actuator 200 in that it has an actuator arm 302 driven by a piston 304 within a cylinder casing 306 by fluid being pumped into or out of a face port 308 and a tail port 310 via hydraulic lines 312. However, the piston 304 is modified so that it will decelerate during retraction. This is done by providing a cavity 316 in the sides of the piston 304 adjacent the cylinder casing 306, and an aperture 318 in the face of the piston 304 which opens onto the cavity 316. Thus, as the piston 304 is retracted, it will initially block the face port 308 (as shown in FIG. 3). Once the piston 304 is sufficiently retracted that the face port 308 opens onto the cavity 316 (as shown in FIG. 4), hydraulic fluid in front of the face of the piston 304 will flow through the aperture 318, into the cavity 316, and then through the face port 308. The aperture 318 is formed with smaller flow area than the face port 308. Therefore, once the piston 304 moves rearwardly of the face port 308, the effective flow area for escape of hydraulic fluid from in front of the face of the piston 304 is reduced, causing the piston to retract at slower speed. The piston 304 therefore has a higher retraction speed over a first portion of its retraction, and a slower retraction speed over the latter portion of its retraction. An optional restrictor 314 having a function similar to that of restrictor 214 is also shown, and may be omitted if desired.

This arrangement works very well to avoid collision between the wing plow 104 and the plowing vehicle 100, but is subject to certain disadvantages. The fluid actuator 300 is not well suited for mass manufacture because different plowing vehicles 100 have hydraulic pumps of different capacities, differently-sized moldboards 102, etc., which leads to the problem that an aperture 318 which is appropriately sized for a desired retraction speed in one plowing vehicle 100 might not be appropriately sized for another plowing vehicle 100. Thus, an approach as in FIGS. 3 and 4 was taken wherein the aperture 318 is defined within a restrictor 320 threadedly inserted in the piston 304. Thus, the piston 304 and cylinder casing 306 could be mass-manufactured, and different restrictors 320 of different sizes could be installed within the pistons 304 to attain the desired retraction speed.

However, this approach is not entirely problem-free because the restrictors 320 cannot be removed and replaced without disassembly of the cylinder casing 306 to remove the piston 304. The cylinder casing 306 is opened at its seams (not shown in the drawings) and the piston is withdrawn, generally after the fluid actuator 300 has been left to drain for a while to avoid excessive spillage of hydraulic fluid. This is messy and time-consuming work, and the time needed to modify the fluid actuator 300 is particularly troublesome. Plowing shops may have a number of different plowing vehicles but may keep only one spare fluid actuator 300 on hand in case of breakage in one of the vehicles. When such breakage occurs, there is generally a need to replace the broken actuator with a new fluid actuator 300 as soon as possible to get the plowing vehicle 100 back on the road. This is difficult to do when one must disassemble the fluid actuator 300 in order to install and properly tune its restrictor 320. Thus, it would be desirable to have a fluid actuator which decelerates in the latter part of its retraction, and which allows a user to tailor such deceleration as desired without having to disassemble the cylinder casing.

SUMMARY OF THE INVENTION

The invention involves a plowing vehicle which incorporates a decelerating fluid actuator, and which is intended to at least partially solve the aforementioned problems. To give the reader a basic understanding of some of the advantageous features of the invention, following is a brief summary of preferred versions of the decelerating fluid actuator. As this is merely a summary, it should be understood that more details regarding the preferred versions may be found in the Detailed Description set forth elsewhere in this document. The claims set forth at the end of this document then define the various versions of the invention in which exclusive rights are secured.

In particularly preferred versions of the invention, a plow including a plowing vehicle and a moldboard has a decelerating fluid actuator. The fluid actuator includes a piston which travels within a cylinder, with an actuator arm extending from the piston so that connection of the actuator arm to one of the plowing vehicle or moldboard, and connection of the cylinder's casing to the other of the plowing vehicle or moldboard, allows adjustable positioning of the moldboard with respect to the plowing vehicle during operation of the fluid actuator. The cylinder has first and second ports which are successively blocked as the piston is retracted within the cylinder, with the second port being blocked after the first port during retraction. An enclosure having an enclosure interior and an enclosure exterior is provided outside the cylinder, with the enclosure interior defining a passage between the ports and connecting the ports to a fluid supply. The flow area of the passage between the ports is adjustable from the enclosure exterior without removal of the enclosure from the cylinder casing. As a result, when the piston begins retraction, fluid in front of the face of the piston may flow through both of the first port and through the enclosure interior to the fluid supply, and also through the second port and through the passage within the enclosure interior to the fluid supply. The flow areas of both the first port and the second port (and passage) are therefore effective to convey fluid to the fluid supply. However, when the piston retracts to a sufficient degree that the first port is blocked, fluid may flow solely through the second port, and in turn through the passage in the enclosure interior to the fluid supply. If the flow area of the passage is smaller than the flow area presented when the first port is unobstructed by the piston, the retraction speed of the piston is reduced once the first port is obstructed (i.e., during the latter portion of retraction), thereby reducing the speed at which the moldboard approaches the plowing vehicle.

To allow adjustment of the retraction speed during the latter portion of retraction, the flow area presented by the passage is preferably made adjustable from the enclosure exterior without the need to remove the enclosure from the cylinder casing. This is preferably done by providing a restrictor within the enclosure between the first and second ports, wherein the restrictor defines the flow area of the passage. In one version of the invention (illustrated in FIGS. 5 and 6), this arrangement may be provided by an aperture extending from the enclosure exterior to the enclosure interior, and a removably insertable member can be received in the aperture to define a door allowing access to the enclosure interior. A removable restrictor having the passage defined therein may then be situated between the first and second ports, and the door may be used to access the restrictor (and remove it and replace it with other restrictors having different aperture sizes) when desired. In another version of the invention (illustrated in FIG. 7), an aperture extends from the enclosure exterior to the enclosure interior, and a removably insertable member can be received in the aperture to rest at least partially within the enclosure interior, and thereby define a restrictor which varies the flow area of the passage in accordance with its degree of removal from the enclosure interior. Other versions of the invention are possible in accordance with the foregoing concepts.

Further advantages, features, and objects of the invention will be apparent from the following detailed description of the invention in conjunction with the associated drawings.

DETAILED DESCRIPTION OF PREFERRED VERSIONS OF THE INVENTION

Figure 1:
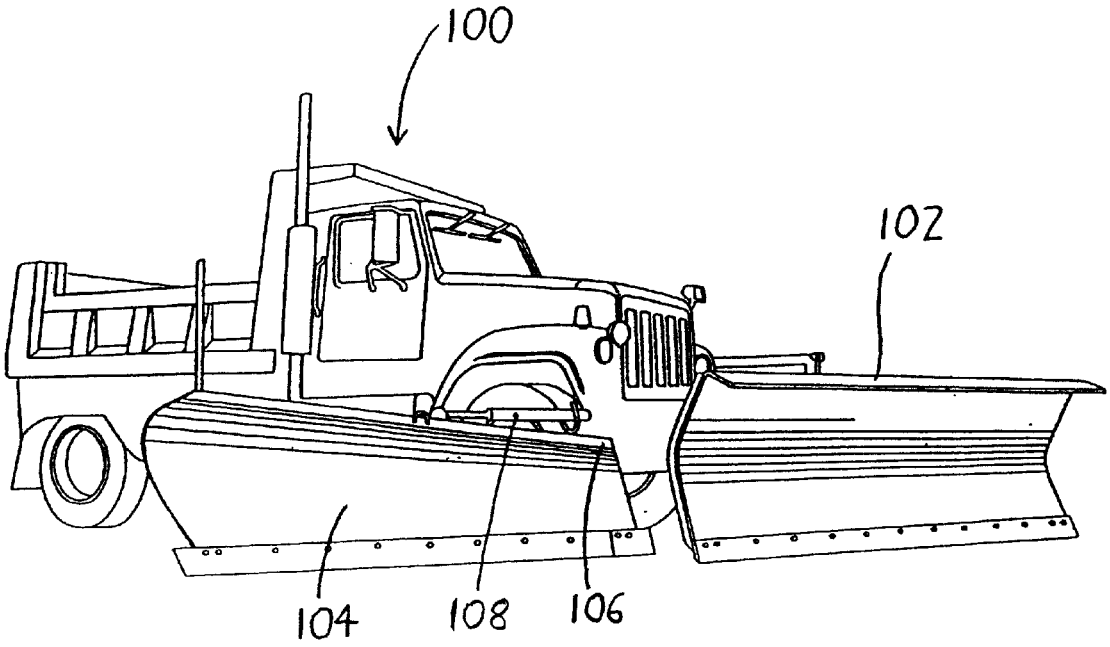
FIG. 1 is a side perspective view of a plow, wherein a plowing vehicle 100 has plow moldboards 102 and 104 affixed thereon, and fluid actuators 108 which drive the plow moldboards with respect to the plowing vehicle.
Figure 5:
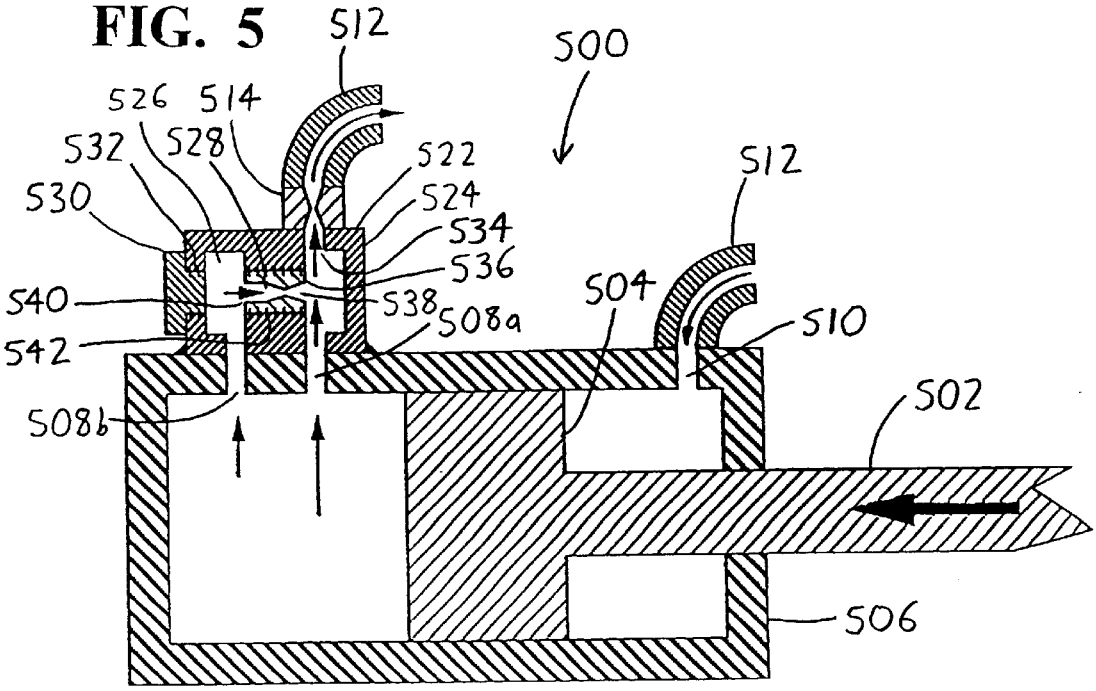
FIGS. 5 and 6 are schematic views of a first preferred version of a decelerating fluid actuator 500 for use in the invention (shown in cross-section), with the piston 504 of the fluid actuator shown in different stages of retraction.
Figure 6:
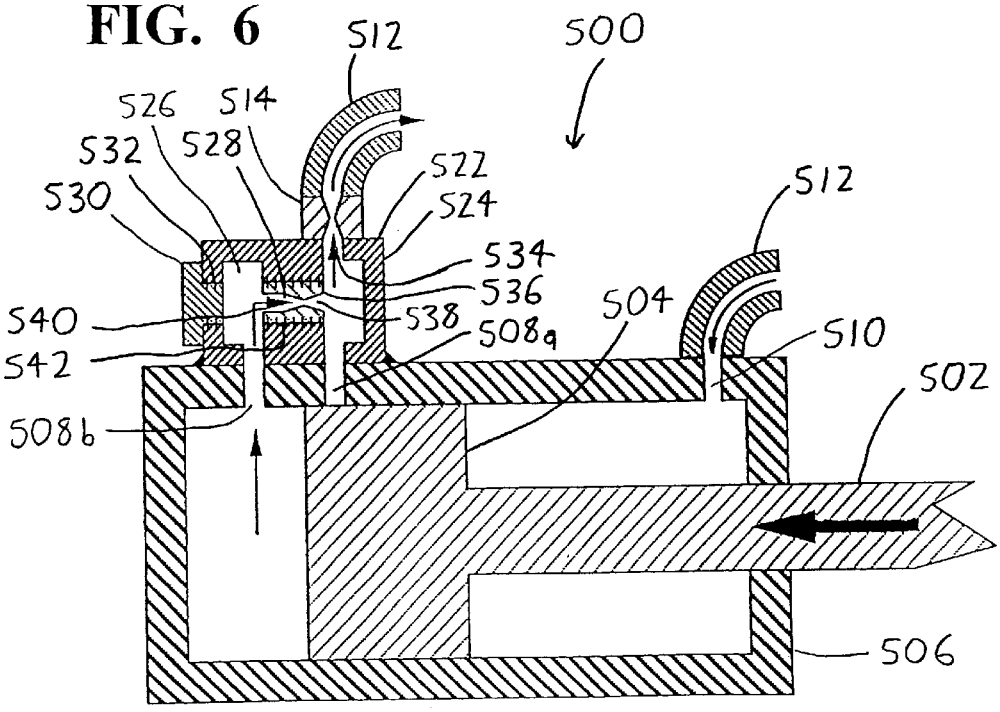

Turning to FIGS. 5 and 6, a first preferred version of a decelerating fluid actuator 500 suitable for use with a plowing vehicle (such as the plowing vehicle 100 of FIG. 1) is schematically illustrated in cross-section. The fluid actuator 500 includes an actuator arm 502 connected to a piston 504, with the piston 504 being movable within a cylinder defined by a cylinder casing 506. The piston 504 is actuated within the cylinder casing 506 by the pressure of fluid coming to or from a first face port 508*a* and/or a second face port 508*b* adjacent the face of the piston 504, and also by the pressure of fluid coming to or from a tail port 510 adjacent the tail of the piston 504. The face ports 508*a*/508*b* are connected by a hydraulic line 512 to a fluid supply (not shown), as is the tail port 510. As the piston 504 travels within the cylinder casing 506 to retract the actuator arm within the cylinder casing 506, the first face port 508*a* and second face port 508*b* are successively blocked by the piston 504, with the second face port 508*b* being blocked after the first face port 508*a*.

Figure 2:
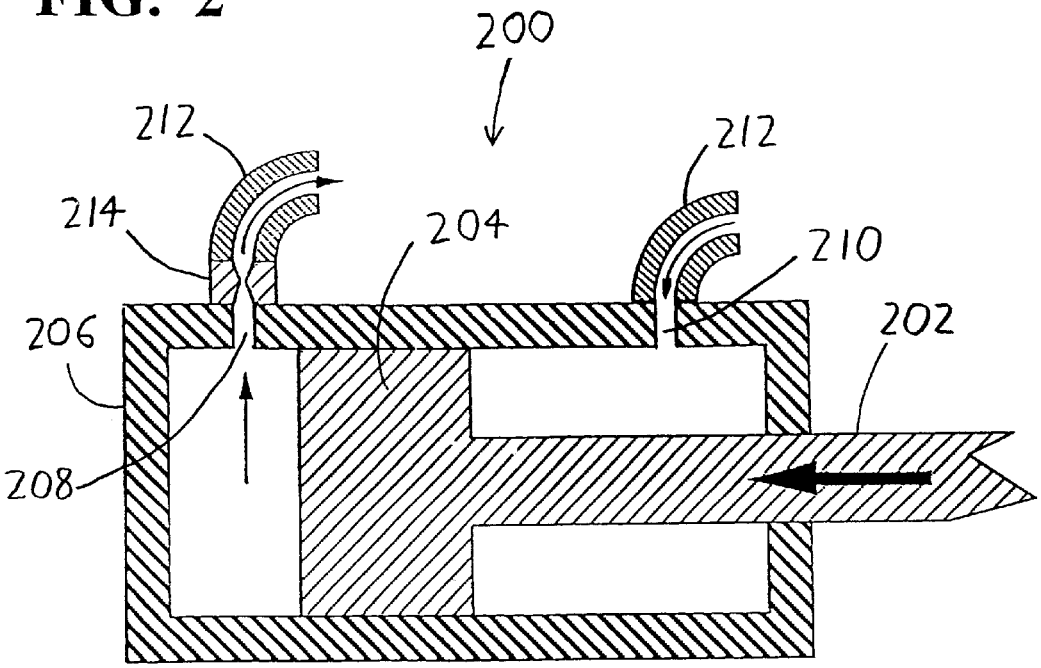
FIG. 2 is a schematic view of a fluid actuator 200 suitable for use in a plow such as that of FIG. 1 (shown in cross-section).
Figure 3:
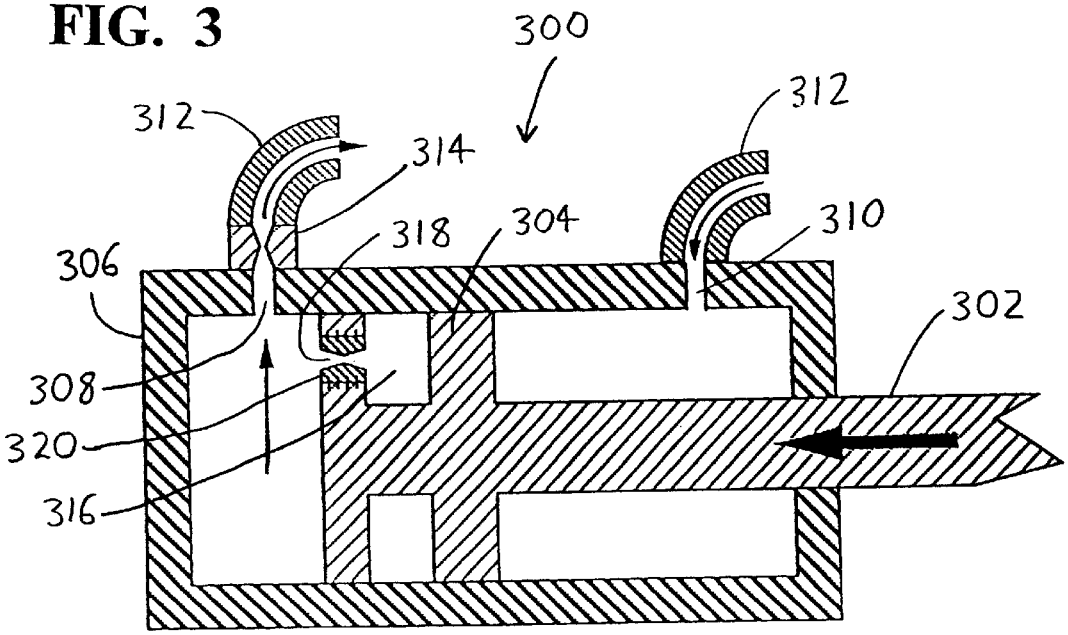
FIGS. 3 and 4 are schematic views of a modified version of the fluid actuator of FIG. 2 (shown in cross-section), with FIGS. 3 and 4 illustrating the piston 304 of the fluid actuator 300 in different stages of retraction.
Figure 4:
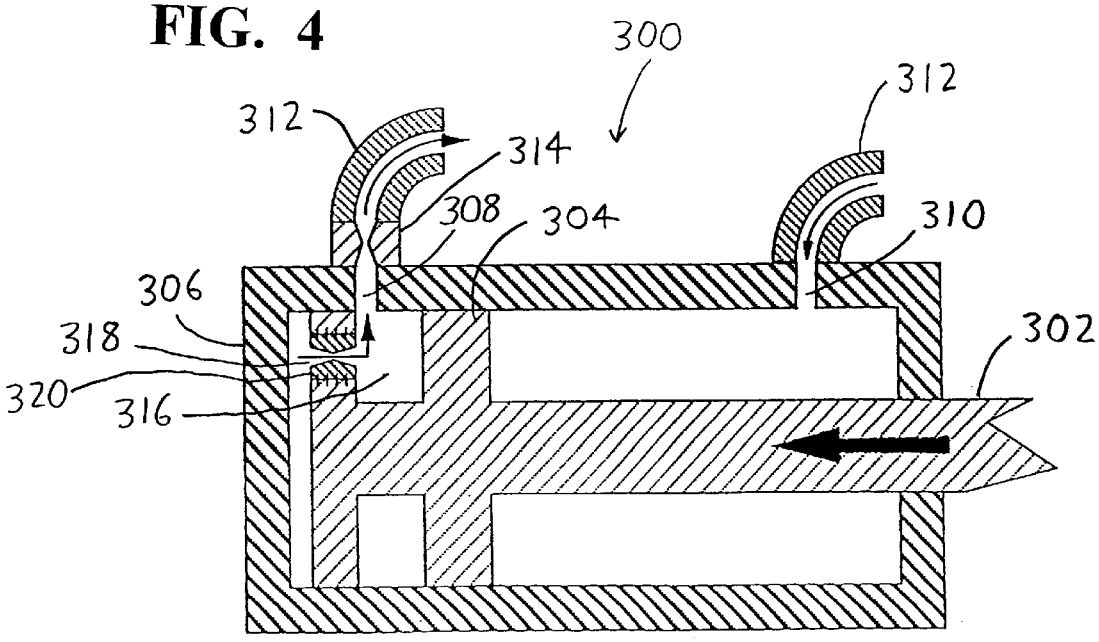

An enclosure 522 is provided on the cylinder casing 506 outside the cylinder (i.e., outside the path of travel of the piston 504), with the enclosure 522 having an enclosure exterior 524 which is preferably contiguous with the cylinder casing 506, and an opposing enclosure interior 526. The enclosure interior 526 defines a passage 528 between the first face port 508*a* and second face port 508*b*. At the side of the passage 528 adjacent the second face port 508*b*, a door 530 leads from the enclosure exterior 524 to the enclosure interior 526. While such a door may take a variety of forms, here the door 530 is depicted as a member which is threaded into an aperture 532 which extends between the enclosure exterior 524 and enclosure interior 526. At the side of the passage 528 adjacent the first face port 508*a*, the passage 528 opens on to an exterior enclosure port 534, which in turn opens onto hydraulic line 512. A restrictor 514 is illustrated between the exterior enclosure port 534 and the hydraulic line 512, but this restrictor 514—which serves essentially the same purpose as the restrictor 214 of FIG. 2—is optional and need not be included.

A restrictor 536 is then provided within the enclosure interior 526 between the first face port 508*a* and second face port 508*b*, with the interior of the restrictor 536 defining a portion of the passage 528 with diminished flow area. Thus, as can be seen by comparison between FIG. 5 and FIG. 6, when the piston 504 is retracted, fluid in front of the face of the piston 504 exits the cylinder casing 506 through both the first face port 508*a* and second face port 508*b* and then through the exterior enclosure port 534, with lesser fluid flowing through the second face port 508*b* owing to the presence of restrictor 536 between the second face port 508*b* and the exterior enclosure port 534. Stated succinctly, greater flow may occur out the first face port 508*a* than second face port 508*b*. Turning then to FIG. 6, when the piston 504 is retracted sufficiently to obstruct the first face port 508*a*, the fluid may only exit through second face port 508*b* (and thus must pass through restrictor 536). Since flow is restricted, the piston 504 experiences greater resistance to retraction once the first face port 508*a* is blocked, and thus the piston 504 slows once it is retracted sufficiently that the first face port 508*a* is blocked.

The door 530 is then beneficial because it allows a user to access the restrictor 536 from the enclosure exterior 524 for adjustment without the need to disassemble the cylinder casing 506 or otherwise remove the piston 504, and the user additionally need not remove the enclosure 522 from the cylinder casing 506. In the fluid actuator 500 shown in FIGS. 5 and 6, the restrictor 536 is provided in the form of a plug which has a portion of the passage 528 defined therein, and which is threadedly inserted within the enclosure interior 526 between the first face port 508*a* and the second face port 508*b*. Close inspection of the restrictor 536 illustrated in FIGS. 5 and 6 with restrictors previously described (e.g., restrictor 514) shows that restrictor 536 is differently shaped: the portion of the passage 528 within the restrictor 536 has a converging orifice portion 538 providing an orifice with reduced flow area, and an engagement portion 540 configured so that an allen wrench, screwdriver, or other common tool can be inserted into the restrictor engagement portion 540 of the passage 528 to engage the restrictor 536. After such a tool is inserted in the engagement portion 540, the restrictor 536 may be adjusted within the enclosure interior 526 by moving it along its threads 542. Thus, if the user needs to rapidly replace a restrictor 536 with a different restrictor having a differently-sized converging orifice portion 538, the user need merely remove the door 530, insert an appropriate fastener within the engagement portion 540 of the restrictor 536, and unscrew it until it may be removed from the door 530. The user may then insert an appropriately-sized restrictor 536, replace the door, and the modified fluid actuator 500 is ready for use.

Figure 7:
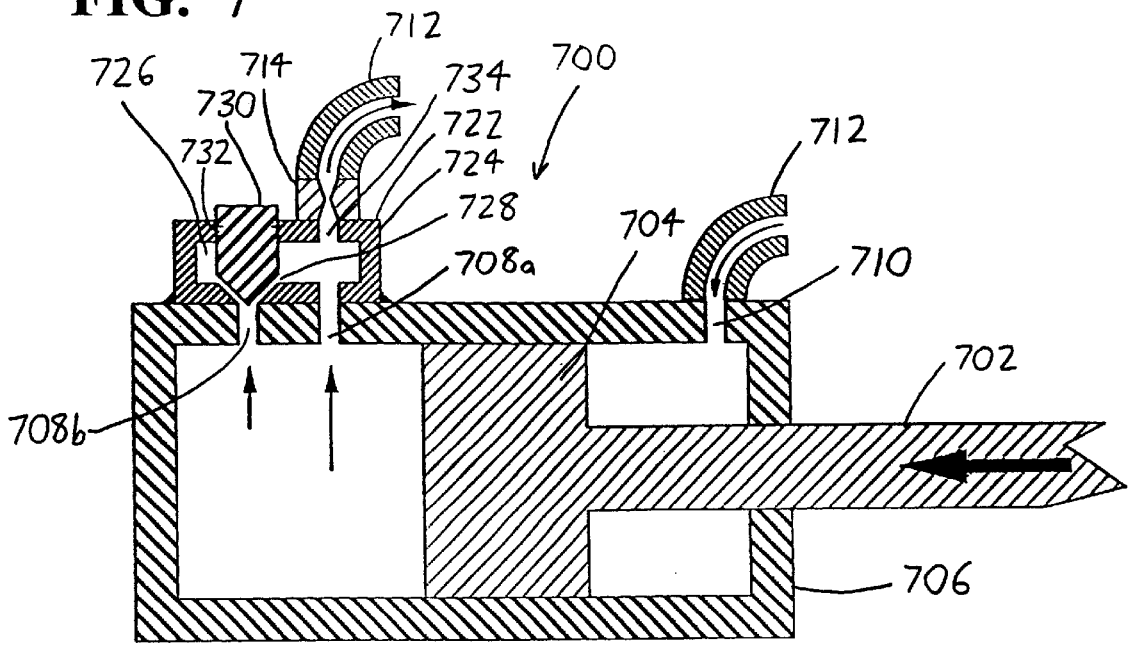
FIG. 7 is a schematic view of a second preferred version of a decelerating fluid actuator 700 for use in the invention (shown in cross-section).

Turning to FIG. 7, a second preferred version of a decelerating fluid actuator for use in the invention is generally depicted by the reference numeral 700. Similarly to the foregoing fluid actuators, an actuator arm 702 is moved by a piston 704 situated within a cylinder casing 706, with the piston 704 being moved within the cylinder by hydraulic fluid coming to/from a first face port 708*a*, a second face port 708*b*, and a tail port 710. Hydraulic lines 712 communicate fluid to these ports, and an optional restrictor 714 (which may be omitted if desired) is also depicted. An enclosure 722 is provided outside the cylinder on the cylinder casing 706, and has an enclosure exterior 724 and an opposing enclosure interior 726 wherein a passage 728 leads between the first and second face ports 708*a* and 708*b*. The size of the passage 728 is regulated by a restrictor 730 which is threadedly inserted into an aperture 732 extending between the enclosure exterior 724 and the enclosure interior 726. Thus, as the piston 704 is retracted within the cylinder casing 706 along the path defined by the cylinder, hydraulic fluid in front of the face of the piston 704 will initially travel through both of the first and second face ports 708*a* and 708*b*, with flow in the second face port 708*b* being lesser (provided the passage 728 defined the restrictor 730 provides less flow area than the first face port 708*a*). When the piston 704 retracts to a sufficient degree that the first face port 708*a* is blocked, fluid will flow solely through the second face port 708*b*, through the passage 728, and in turn through the exterior enclosure port 734. Since the effective flow area for hydraulic fluid is reduced once the first face port 708*a* is blocked, retraction of the piston 704 is slowed during the latter portion of retraction of the piston 704.

The various preferred versions of the invention are shown and described above to illustrate different possible features of the invention and the varying ways in which these features may be combined. Apart from combining the different features of the above versions in varying ways, other modifications are also considered to be within the scope of the invention. Following is an exemplary list of such modifications.

A wide variety of other restrictor arrangements are possible apart from those described here. For example, the restrictor 536 of FIG. 5 could be integrally formed within enclosure 522, and might be provided to a user with a minimally-sized converging orifice portion 538. If the user then requires a larger converging orifice portion 538, a user may insert a drill bit into door 530, bore out the converging orifice portion 538 to adjust its size as desired, and then close the door 530 to prepare the fluid actuator 500 for use. Naturally, this only allows only upward adjustment in the size of the converging orifice portion 538 rather than downward sizing, though a user might insert a separate restrictor (similar to restrictor 536) within the bored-out converging orifice portion 538 if downward sizing is desired.

As another example, the restrictor 536 in the fluid actuator 500 need not include a converging orifice portion 538 at all, and the restrictor engagement portion 540 may simply be extended through the restrictor 536 to provide the passage 528. The flow area between the first face port 508*a* and the exterior enclosure port 534 may then be adjusted by moving the end of the restrictor 536 sufficiently close to the door 530 that the space between that end of the restrictor 536 and the door 530 effectively becomes the restrictor's converging orifice portion. Alternatively, the door 530 might itself include a protruding portion which extends partway into the passage 528 to reduce its effective flow area (in which case the door 530 effectively becomes a restrictor similar to the restrictor 730 of FIG. 7).

The invention is not intended to be limited to the preferred versions described above, but rather is intended to be limited only by the claims set out below. Thus, the invention encompasses all alternate versions that fall literally or equivalently within the scope of these claims.

What is claimed is:

1. A plow comprising:

a. a plow moldboard;

b. a decelerating fluid actuator driving the plow moldboard, the decelerating fluid actuator including:

(1) a piston;

(2) an actuator arm connected to the piston;

(3) a cylinder wherein the piston travels, and from which the actuator arm is extended and retracted during such travel, the cylinder having first and second ports which are successively blocked as the piston travels within the cylinder to retract the actuator arm, the second port being blocked after the first;

(4) an enclosure situated outside the cylinder, the enclosure having an enclosure interior and an enclosure exterior, wherein the enclosure interior defines a passage between the ports;

(5) a restrictor within the enclosure between the first and second ports, the restrictor being accessible from the enclosure exterior without removal of the enclosure.

2. The plow of claim 1 wherein the enclosure includes a door leading from the enclosure exterior to the enclosure exterior, the door being openable to allow access to the restrictor for adjustment.

3. The plow of claim 2 wherein the restrictor is threaded within the passage between the first and second ports.

4. The plow of claim 3 wherein the restrictor is insertable within the passage along an axis extending to the door, whereby the restrictor may be removed from the door by withdrawing it along the axis.

5. The plow of claim 1 wherein the restrictor extends from the enclosure exterior to the passage within the enclosure interior.

6. The plow of claim 5 wherein the restrictor is threaded within the enclosure.

7. A plow comprising:

a. a plowing vehicle;

b. a plow moldboard;

c. a decelerating fluid actuator interposed between the plowing vehicle and the plow moldboard, the decelerating fluid actuator including:

(1) a piston;

(2) an actuator arm connected to the piston;

(3) a cylinder wherein the piston travels and from which the actuator arm is extended and retracted during such travel, the cylinder having first and second ports which are successively blocked as the piston travels within the cylinder, the second port being blocked after the first port when the actuator arm is retracted;

(4) an enclosure having an enclosure interior and an enclosure exterior, the enclosure interior defining a passage connecting the ports and leading to a fluid supply;

(5) a restrictor situated in the passage between the ports, wherein:

i. the restrictor is situated between the second port and the fluid supply, whereby fluid flow from within the cylinder and through the second port to the fluid supply is restricted so that the piston retracts more slowly under constant fluid pressure after the first port is blocked; and ii. the restrictor is accessible from the enclosure exterior for removal from the enclosure interior, thereby allowing adjustment of the restrictor without disassembly of the enclosure from the cylinder.

8. The plow of claim 7 wherein the enclosure includes:

a. an aperture extending from the enclosure exterior to the enclosure interior, and b. a member removably insertable into the aperture.

9. The plow of claim 8 wherein the member defines a door allowing access to the passage, with the restrictor resting within the passage spaced from the door.

10. The plow of claim 8 wherein the member defines the restrictor.

11. The plow of claim 10 wherein the restrictor is threadedly insertable into the aperture.

12. A plow comprising a plowing vehicle, a moldboard, and a decelerating fluid actuator which adjustably positions the moldboard with respect to the plowing vehicle, wherein the decelerating fluid actuator includes:

a. a piston;

b. an actuator arm connected to the piston;

c. a cylinder wherein the piston travels and from which the actuator arm is extended and retracted during such travel, the cylinder having first and second ports which are successively blocked as the piston travels within the cylinder, the second port being blocked after the first port as the actuator arm is retracted;

d. an enclosure having an enclosure interior and an enclosure exterior, the enclosure interior defining a passage between the ports and leading to a fluid supply, and wherein the area of the passage between the ports is adjustable from the enclosure exterior without removal of the enclosure.

13. The plow of claim 12 further comprising:

a. a restrictor removably situated within the passage, and b. a door extending from the enclosure exterior to the enclosure interior, wherein the restrictor is situated adjacent the door.

14. The plow of claim 13 wherein the restrictor is threadedly withdrawable from the passage along an axis aligned with the door.

15. The plow of claim 12 further comprising a restrictor extending from the enclosure exterior to the enclosure interior, the restrictor being extendable within the passage to adjust the area of the passage.

16. The plow of claim 15 wherein the restrictor is threadedly inserted into the enclosure.

* * * * *